US008230937B1

(12) United States Patent
Asay et al.

(10) Patent No.: US 8,230,937 B1
(45) Date of Patent: Jul. 31, 2012

(54) PROJECTILE CONTAINING METASTABLE INTERMOLECULAR COMPOSITES AND SPOT FIRE METHOD OF USE

(75) Inventors: Blaine W. Asay, Los Alamos, NM (US); Steven F. Son, West Lafayette, IN (US); V. Eric Sanders, Los Alamos, NM (US); Timothy Foley, Los Alamos, NM (US); Alan M. Novak, Los Alamos, NM (US); James R. Busse, South Fork, CO (US)

(73) Assignee: The United States of America as represented by the Secretary of Department of Energy, Washington, DC (US)

( * ) Notice: Subject to any disclaimer, the term of this patent is extended or adjusted under 35 U.S.C. 154(b) by 489 days.

(21) Appl. No.: 12/561,311

(22) Filed: Sep. 17, 2009

(51) Int. Cl.

| | |
|---|---|
| ***A62C 3/02*** | (2006.01) |
| ***A62C 3/00*** | (2006.01) |
| ***A62C 2/00*** | (2006.01) |
| ***F42B 12/46*** | (2006.01) |
| ***F42B 12/44*** | (2006.01) |
| ***F42B 12/00*** | (2006.01) |

(52) U.S. Cl. ..... 169/43; 102/364

(58) Field of Classification Search ..... 169/27, 169/28, 36, 43, 44, 46; 102/283, 293, 364
See application file for complete search history.

(56) References Cited

U.S. PATENT DOCUMENTS

| | | | | |
|---|---|---|---|---|
| 4,616,711 | A * | 10/1986 | Johnson | 169/45 |
| 5,739,461 | A * | 4/1998 | Jacobson | 102/338 |
| 5,783,768 | A * | 7/1998 | Jacobson | 102/334 |
| 7,210,537 | B1 * | 5/2007 | McNeil | 169/46 |
| 7,451,679 | B2 * | 11/2008 | Stevenson et al. | 89/1.51 |
| 2006/0288897 | A1 * | 12/2006 | Williams et al. | 102/364 |

* cited by examiner

*Primary Examiner* — Darren W Gorman
(74) *Attorney, Agent, or Firm* — Thomas S. O'Dwyer; James C. Durkis; John T. Lucas

(57) ABSTRACT

A method for altering the course of a conflagration involving firing a projectile comprising a powder mixture of oxidant powder and nanosized reductant powder at velocity sufficient for a violent reaction between the oxidant powder and the nanosized reductant powder upon impact of the projectile, and causing impact of the projectile at a location chosen to draw a main fire to a spot fire at such location and thereby change the course of the conflagration, whereby the air near the chosen location is heated to a temperature sufficient to cause a spot fire at such location. The invention also includes a projectile useful for such method and said mixture preferably comprises a metastable intermolecular composite.

8 Claims, 2 Drawing Sheets

Figure 1. Pressure history for two experiments, each having 2 pressure measurements.

PROJECTILE CONTAINING METASTABLE INTERMOLECULAR COMPOSITES AND SPOT FIRE METHOD OF USE

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. W-7405-ENG-36 awarded by the U.S. Department of Energy and Los Alamos National Laboratory.

CROSS-REFERENCE TO RELATED APPLICATIONS

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a projectile comprising metastable intermolecular composite materials and use of such projectiles to combat a conflagration.

2. Description of Related Art

Explosives are energetic materials that typically include an oxidant and a reductant that react rapidly with each other to produce product gases (e.g., $CO_2$, $H_2O$, and others) and energy in the form of heat and shock. Explosives such as TNT, TATB, RDX, and nitroglycerine produce energy at a very fast and uncontrolled rate. For applications that require a more controlled rate of energy production, "Metastable Intermolecular Composite" (MIC) materials, also known in the art as "Metastable Interstitial Composite" materials, have been developed.

MIC materials have been described, for example, in U.S. Pat. No. 5,266,132 to W. C. Danen et al. entitled "Energetic Composites," and in U.S. Pat. No. 5,606,146 to W. C. Danen et al. entitled "Energetic Composites and Method of Providing Chemical Energy," both hereby incorporated by reference. The MIC materials described in the '132 and '146 patents are layered materials that include alternating layers of oxidant and reductant. The oxidant layers are physically separated from the reductant layers by buffer layers. When the buffer layers are disrupted, the oxidant and reductant layers come into contact and react to produce chemical energy. The amount of energy produced and the rate of energy production depend on, among other things, the chemical composition of the oxidant and reductant layers and the number and thickness of these layers.

MIC materials in the form of powders are also known (see U.S. Pat. No. 5,717,159 to G. Dixon et al. entitled "Lead-Free Percussion Primer Mixes Based on Metastable Interstitial Composite (MIC) Technology," and U.S. Pat. No. 6,666,936 to B. Jorgensen et al. entitled "Energetic Powder," both hereby incorporated by reference. The MIC powders of the '159 patent are a blend of oxidant powder and reductant powder. The powders are used as percussion primers. The reductant powder is aluminum powder made up of aluminum particles having a thin oxide coating. One percussion primer composition is a mixture of about 45 weight percent of reductant aluminum powder and about 55 weight percent of oxidant molybdenum trioxide powder. Another primer composition is a mixture of about 50 wt % aluminum powder and about 50 wt % polytetrafluoroethylene.

Metastable Intermolecular Composite materials differ from more conventional composite materials in that the individual reductant particle sizes of MIC materials are on the nanoscale ($10^{-9}$ meter) instead of millimeter or sub-millimeter scale ($10^{-4}$ meter to $10^{-5}$ meter). These changes in the particle size result in significant changes in the chemical and mechanical properties of the powder mixture. The burn rate observed for MIC powder composed of these smaller sized powder reductant particles is much higher than for powder composed of larger reductant particles. Instead of burning at tens of millimeters per second, for example, MIC materials are capable of combustion velocities of tens of meters per second up to kilometers per second. The physical properties of the particles, such as melting points, can also change drastically.

Spot fires are used to change the course of large forest fires and other wildfires, but in order for the main fire to be drawn to the spot fire, the smaller fire must be hotter. This is because the higher temperature creates a larger oxygen consumption, which in turn creates the draft that draws the main fire to the spot fire. Stronger drafts make the spot fires more effective.

Currently, spot fires are started by dispensing small balls, approximately the size of ping-pong balls, filled with an anti-freeze/permanganate solution. However, the balls often jam in the dispenser, thus creating a hazard on the dispensing aircraft. Consequently, firefighters need a safer and more effective means to start spot fires. Gelled gasoline is sometimes used for this purpose, which again has problems with safe transport and deployment.

The present invention provides a spot fire accelerant system and projectile that is safer, hotter, and can be made compatible with existing aircraft. A MIC material is preferably used as the basis for the spot fire starter. These are solid and very stable and when ignited release significantly more heat than antifreeze/permanganate solutions. MICs can be easily packaged in many different configurations.

Because MIC materials are so stable and insensitive, they can be transported safely. In addition, if a ball containing MICs jams in the dispenser, it will not ignite and can be removed without danger.

BRIEF SUMMARY OF THE INVENTION

The present invention is of a method for altering the course of a conflagration, comprising: firing a projectile comprising a powder mixture of oxidant powder and nanosized reductant powder at velocity sufficient for a violent reaction between the oxidant powder and the nanosized reductant powder upon impact of the projectile; and causing impact of the projectile at a location chosen to draw a main fire to a spot fire at such location and thereby change the course of the conflagration; whereby the air near the chosen location is heated to a temperature sufficient to cause a spot fire at such location. In the preferred embodiment, the oxidant powder comprises metal oxide powder (most preferably bismuth oxide powder), and the nanosized reductant powder comprises nanosized metal powder (most preferably nanosized aluminum powder). The velocity is preferably at least approximately 50 meters per second and the temperature of the air near the impact location is heated to a temperature of from about 2000 degrees Celsius to about 3000 degrees Celsius. The mixture preferably comprises a metastable intermolecular composite.

The present invention is also of a method for destroying a target structure without causing significant damage to nearby non-target structures, comprising: firing at the target structure a projectile comprising a powder mixture of oxidant powder and nanosized reductant powder; and impacting the target structure with the projectile. In the preferred embodiment, the oxidant powder comprises metal oxide powder (most preferably bismuth oxide powder), and the nanosized reductant powder comprises nanosized metal powder (most preferably nanosized aluminum powder). The mixture preferably comprises a metastable intermolecular composite.

The invention is further of a projectile comprising a powder mixture of oxidant powder and nanosized reductant powder and a cartridge for holding the powder mixture. In the preferred embodiment, the oxidant powder comprises metal oxide powder (most preferably bismuth oxide powder), and the nanosized reductant powder comprises nanosized metal powder (most preferably nanosized aluminum powder). The mixture preferably comprises a metastable intermolecular composite.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 2:
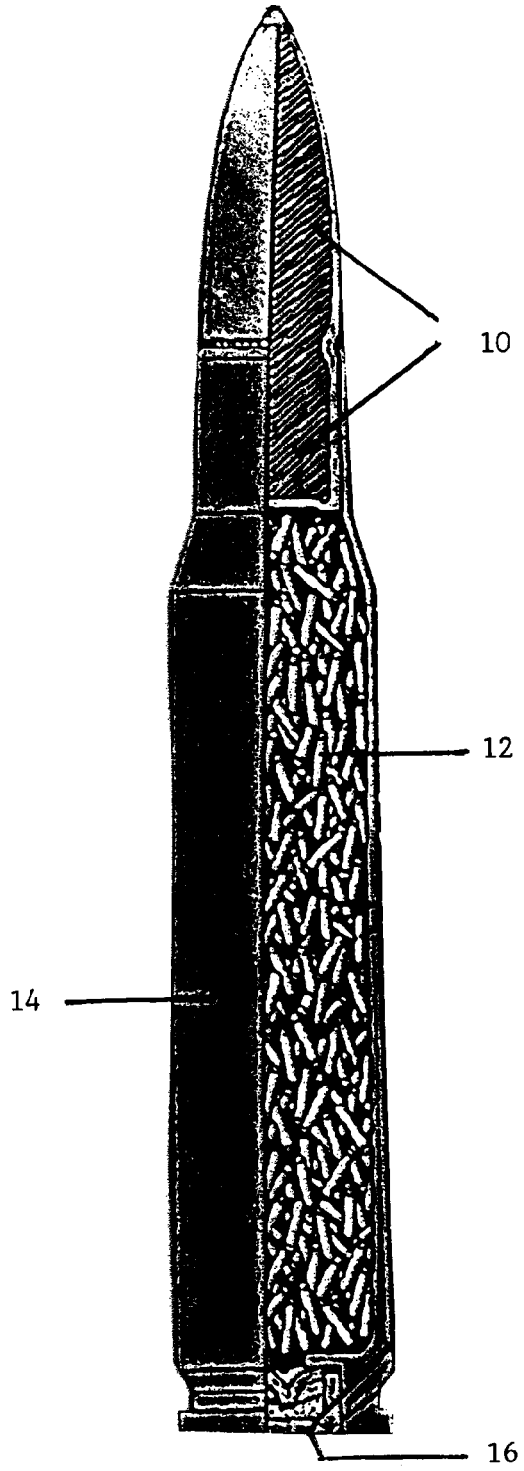
FIG. 2 is a schematic diagram of a possible projectile of the invention.

Referring to FIG. 2, the present invention is of a possible projectile 10 that includes a metastable intermolecular composite material 12, preferably a powder mixture of oxidant powder and nanosized reductant powder, a suitable primer 16, and a cartridge 14 for holding the powder mixture. The projectile is particularly useful for starting spot fires in order to change the course of a wildfire, and also for destroying target structures without causing significant damage to nearby non-target structures. For purposes of the specification and claims, "nanosized" means average particle sizes of less than approximately 100 nm.

Metastable Intermolecular Composites (MICs) are materials comprised of nanoscale composite energetic materials, often a metal and an oxidizer. Similar in composition to classical composites, MICs differ in that the individual reductant particle sizes are on the nanometer scale ($10^{-9}$ m) instead of millimeter or sub-millimeter ($10^{-4}$ m to $10^{-3}$ m). This significant change in spatial scale significantly changes the chemical and mechanical properties, enabling a new set of behaviors. For example, instead of burning at tens of millimeters per second, MICs are capable of combustion velocities of tens of meters per second up to kilometers per second. Physical properties such as melting points can also change drastically. These differences make these a new class of materials.

One can deploy MICs in a reactive projectile that reacts violently upon impact when fired at velocities ranging from 50 to 500 m/s. These reactions rapidly (<100 ms) heat the surrounding air to 2000-3000 degrees C. Depending on the specific formulation, the reactions can be extended as the products further react with the surrounding air to produce pressure and temperature rises over several hundred milliseconds. In a confined environment pressure rises of tens of psi are obtained. The pressure pulses can be specifically tailored to the desired application.

The invention is also of a method for changing the course of a wildfire. The method involves setting a spot fire at a location chosen so as to draw a wildfire to the spot fire and thereby change the course of the wildfire. The spot fire is set by sending a projectile that includes a powder mixture of unreacted oxidant powder and nanosized reductant powder at the location desired for setting the spot fire at a velocity sufficient for a violent reaction of the powder mixture upon impact at the location. The air nearby the impact is heated to a temperature sufficient to cause a spot fire at the impact location.

The invention is further of a method for destroying a target structure without causing significant damage to nearby non-target structures. The method involves impacting a projectile of unreacted powder mixture of oxidant powder and nanosized reductant powder at the target structure.

Again, the invention relates to a projectile made from metastable intermolecular composite (MIC) materials, and uses for such projectiles. The projectile of the invention reacts violently upon impact when fired at a velocity ranging from about 50 meters/second (m/s) to about 500 m/s. Heat is rapidly released (in less than about 100 milliseconds), enough to raise the temperature of the surrounding air to a temperature of from about 2000 degrees Celsius to about 3000 degrees Celsius.

Depending on the specific formulation, the reactions can be extended as the products react further with the surrounding air to produce pressure and temperature rises over several hundred milliseconds. In a confined environment, pressure rises of tens of psi are obtained. The pressure pulses can be specifically tailored to the desired application.

One important commercial application is for safely igniting spot fires from aircraft, for example, for changing the course of wildfires. These small fires are purposely set to draw a larger fire into an area that has had the fuel reduced and thus control the spread of a wildfire. Methods currently used to set these spot fires that involve firing reactive chemicals from an aircraft flying above the fire have had limited success. These methods are oftentimes unsatisfactory because of jamming and other problems. More commonly, these fires are set very laboriously on the ground by firefighters. These problems would be avoided if a reactive projectile were configured that would not require special guns.

Another application is in targeted destruction of a military or non-military target and its contents without significant damage to surrounding structures or rooms. This effect is very useful in certain situations, but heretofore difficult to achieve.

One aspect of the invention relates to a reactive projectile that includes a standard cartridge packed with a MIC formulation designed to react at a specified impact velocity for a predetermined amount of time, producing a specified pressure and temperature rise. High-density materials have been developed and tested that work well for this application. High-density materials will have a much better performance than typical low-density energetic materials.

To demonstrate the invention, a projectile was prepared using bismuth oxide ($Bi_2O_3$) and aluminum (Al). These material were combined to form a MIC, that was then pressed into a standard copper cartridge case, which was then placed into a sabot and fired from a gun at velocities from about 50 m/s to about 500 m/s. Depending on the particle size of the materials and other parameters, different pressurization rates were observed.

Figure 1:
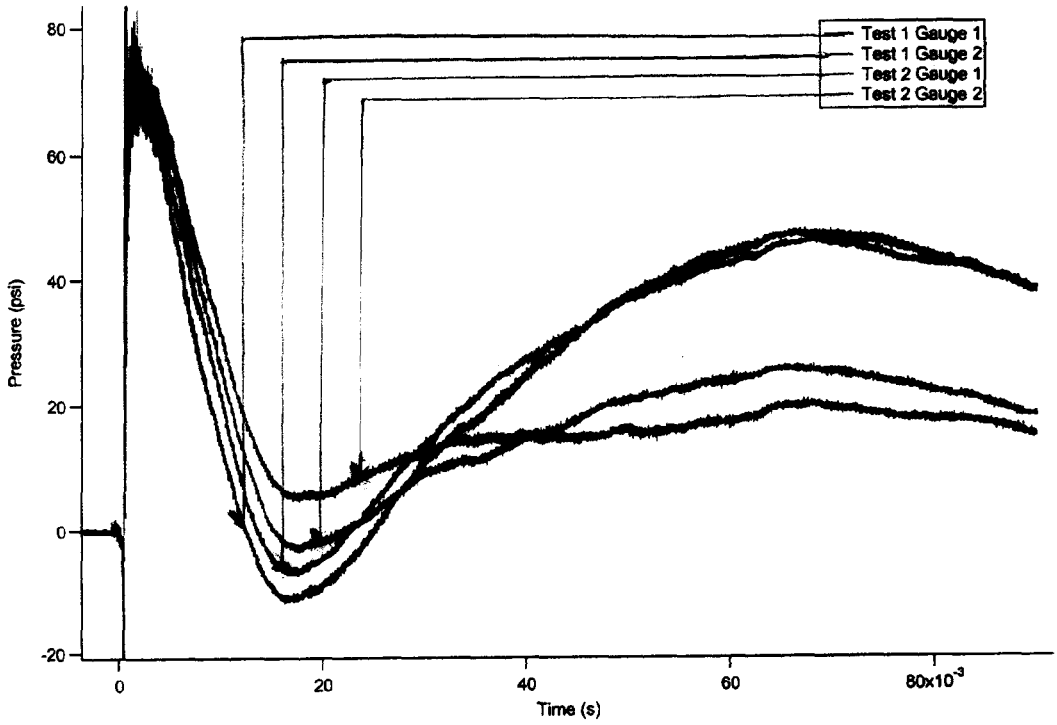
FIG. 1 shows a graph of pressure (psi) versus time (seconds) for a MIC projectile of the invention of bismuth oxide and aluminum pressed into a standard copper cartridge case and fired at a velocity of 400 m/s.

FIG. 1 graphically shows pressure versus time results for a projectile fired at 400 m/s into a closed chamber. The pressure rise is significant, and the time over which the reaction occurs is several hundred milliseconds. Note the distinct afterburning. This pressure history is sufficient to destroy a desired target in the near field and leave the far field untouched.

Other suitable reductants for use with the invention include Ta, W, Hf, and Zr. Other suitable oxidants include $WO_2$, $BiO_2$, and $MoO_3$. As understood by one skilled in the art, for different application different combinations of oxidant and reductant can be employed to achieve desired effects. Furthermore, the size of the particles can be manipulated to again achieve desired results.

Other useful applications for the projectile of the invention include mine clearing operations, reactive bullets, improvised explosive device clearing and vehicle burn improvised explosive device neutralization.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method for altering the course of a conflagration, the conflagration including a main fire, the method comprising the steps of:

firing a projectile comprising a powder mixture of nanosized oxidant powder and nanosized reductant powder at a velocity sufficient for a violent reaction between the nanosized oxidant powder and the nanosized reductant powder upon impact of the projectile; and causing impact of the projectile to set a spot fire at a location which is different from a location of the main fire, in order to draw the main fire to the spot fire location, thereby changing the course of the conflagration;

wherein the air near the spot fire location is heated to a temperature greater than a temperature of the main fire, sufficient to draw the main fire to the spot fire location.

2. The method of claim 1, wherein the oxidant powder comprises metal oxide powder.

3. The method of claim 2, wherein the oxidant powder comprises bismuth oxide powder.

4. The method of claim 1, wherein the nanosized reductant powder comprises nanosized metal powder.

5. The method of claim 4, wherein the nanosized reductant powder comprises nanosized aluminum powder.

6. The method of claim 1, wherein the velocity sufficient for producing a violent reaction comprises a velocity of at least approximately 50 meters per second.

7. The method of claim 1, wherein the temperature of the air near the chosen (impact) location is heated to a temperature of from about 2000 degrees Celsius to about 3000 degrees Celsius.

8. The method of claim 1 wherein the mixture comprises a metastable intermolecular composite.

* * * * *